United States Patent [19]

Stambaugh et al.

[11] 4,095,955

[45] Jun. 20, 1978

[54] FUEL SEPARATION PROCESS

[75] Inventors: Edgel P. Stambaugh, Worthington; Satya P. Chauhan, Columbus, both of Ohio

[73] Assignee: Battelle Development Corporation, Columbus, Ohio

[21] Appl. No.: 683,518

[22] Filed: May 5, 1976

[51] Int. Cl.[2] ..... C10L 9/10; C10B 57/00

[52] U.S. Cl. ..... 44/1 R; 44/1 C; 201/17

[58] Field of Search ..... 44/1 R, 1 C; 75/6; 201/17

[56] References Cited

U.S. PATENT DOCUMENTS

| | | | |
|---|---|---|---|
| 618,104 | 1/1899 | Kenevel | 201/17 X |
| 3,393,978 | 7/1968 | Murphy et al. | 201/17 X |
| 3,928,024 | 12/1975 | Mueller et al. | 75/6 |

*Primary Examiner*—Carl F. Dees

*Attorney, Agent, or Firm*—Philip M. Dunson; C. Henry Peterson

[57] ABSTRACT

Fine particles of a solid carbonaceous fuel of the coal or coke type are treated to reduce their content of undesired constituents at least including sulfur or ash or both. The treatment comprises forming a mixture of the fuel particles with a liquid aqueous leaching solution, containing one or more cations selected from Groups IA and IIA of the periodic table, which is effective to dissolve the undesired constituents. The mixture is exposed to temperatures in the range of about 150° to 375° C under a pressure of at least the autogeneous steam pressure until the solution has dissolved the undesired constituents of the fuel to such an extent that the undesired constituent content of the fuel particles has been reduced to less than a desired limit. The major portion of the solution is then separated from the fuel particles under temperature and pressure conditions and within a time period such that the amount of the undesired constituents dissolved in the solution is not substantially reduced by precipitation, adsorption on the fuel particles, or chemical recombination therewith. The separation is typically carried out by filtering the solution to remove the solid fuel particles. The temperature of the mixture is typically maintained in the range of about 100° to 375° C during the separation step, desirably at about the same temperature and pressure as those used during the dissolving step.

7 Claims, 2 Drawing Figures

FUEL SEPARATION PROCESS

RELATED APPLICATIONS

This invention relates to an improved process for treating fine particles of solid carbonaceous fuel of the coal or coke type. Related processes are disclosed in the copending United States patent application of Edgel P. Stambaugh and George F. Sachsel, Ser. No. 565,454, filed Apr. 7, 1975 and now U.S. Pat. No. 4,055,400 for Extracting Sulfur and Ash; the application of Edgel P. Stambaugh and Satya P. Chauhan, Ser. No. 563,837, filed Mar. 31, 1975 and now abandoned for Treating Solid Fuel; the application of Edgel P. Stambaugh, James F. Miller and Satya P. Chauhan, Ser. No. 576,716, filed May 12, 1975 and now abandoned for Carbonate Treatment; the application of Joseph H. Oxley, Edgel P. Stambaugh and John F. Foster, Ser. No. 588,027, filed June 18, 1975 and now abandoned for Converting Fuels and the application of Edgel P. Stambaugh, Herman F. Feldman and Satya P. Chauhan, Ser. No. 602,258, filed Aug. 6, 1975 and now abandoned for Pyrolizing Coal.

BACKGROUND AND SYNOPSIS

The present invention relates more particularly to improvements in the foregoing processes, in general termed hydrothermal processes, for removing undesired constituents, especially sulfur, ash, or both, from a solid carbonaceous fuel of the coal or coke type. The coal, coke or the like is ground into fine particles that are mixed with an aqueous leaching solution and subjected to a pressure leaching operation.

The pressure leaching is performed at elevated temperature and pressure for a period of time sufficient to dissolve the undesired constituents to a desired extent. Thereby the undesired constituent content of the fuel is reduced to a value below an acceptable limit. This limit is usually dictated by environmental protection standards.

The solid fuel particles are then separated from the leaching solution, which carries away the undesired constituents removed during the leaching. The product is a clean solid fuel that can be more readily burned, liquefied, gasified, or otherwise utilized. It causes considerably less fouling and damage to equipment, and significantly less pollution of the environment, than the original fuel.

Pressure leaching has been employed in the metallurgical industry for separation of metallic components by the selective solubilization of individual compounds. This is achieved by heating an ore concentrate or a mixture of the metal components in an aqueous solution, acidic or basic. Selectivity, i.e., selective solubilization of the components, is achieved by adjusting the reaction parameters — temperature, pressure, time, pH of the solution, and type of leachant. For example, FeO separation from $TiO_2$ in ilmenite ore (FeO — $TiO_2$) is achieved by pressure leaching of the ore in sulfuric acid at elevated temperatures and pressures. Another example, which illustrates the behavior of metal compounds in alkali solutions, is the extraction of aluminia from bauxite ores. In this case, the ore is heated in sodium hydroxide solution at elevated temperature and pressures to selectively solubilize the aluminum value. The solution, containing the solubilized aluminum after separation from the insoluble portion of the ore, is then cooled, whereupon the aluminum values precipitate as aluminum hydroxide. If the solution containing the aluminum values were cooled and let stand in the presence of the insoluble portion of the ore, precipitation of the aluminum hydrate onto the insoluble portion of the ore would occur.

In the hydrothermal treatment of coal, it has been discovered that similar solubilization and precipitation processes must be appropriately managed. A significant portion of the ash and the sulfur are solubilized by pressure leaching of the coal in aqueous solutions. Cooling of these aqueous solutions in the presence of the clean coal can result in contamination of the coal by ash precipitated from solution onto the coal. However, this contamination can be prevented by separating the solution containing the ash and sulfur from the solution before precipitation of the ash can occur. One specific method for achieving separation of solubilized ash from the clean coal is pressure filtration. Pressure filtration achieves another goal, that is, it prevents contamination of the clean coal by the reprecipitation of a portion of the solubilized sulfur. Another advantage is that it allows rapid separation of the clean coal from the aqueous solution. If the solution is allowed to cool in the presence of the coal, a finely divided precipitate forms. This precipitate significantly reduces the rate of filtration, i.e., the separation of the clean coal from the spent leach liquor.

The present invention is concerned with precipitation, adsorption and chemical recombination effects which differ significantly from the mere solidification or freezing of elemental sulfur that occurs on cooling of a hot water slurry in other coal desulfurization processes such as that described in U.S. Pat. No. 3,824,084 to Dillon, wherein the slurry is filtered at temperatures above the freeze point of sulfur. The present invention contemplates the use of leaching solutions such as a sodium hydroxide solution in which elemental sulfur cannot exist.

It has been found that the separation of the spent leachant from the product slurry, obtained by the hydrothermal leaching treatment, at the temperature and the pressure of treatment results in a lower sodium and ash content of the solid fuel product than that resulting from the conventional processing of the product slurry. One exploratory experiment was performed to determine if the sodium and the ash content could be lowered further by carrying out the pressure filtration at temperatures other than the leaching temperature. In the experiment a coal was treated with NaOH at 250° C, the product slurry was allowed to cool to 200° C and then pressure filtration was started. The rate of filtration was found to be extremely slow, indicating that the frit (used for filtration) was plugged. However, on reheating of the slurry to 250° C the rate of filtration was greatly improved.

The above results suggest that the cooling of the product slurry in the precipitation of the ash dissolved during hydrothermal treatment. Moreover, the process of precipitation on cooling and dissolution on heating is a reversible one.

Additional experiments were carried out using high-temperature, high-pressure filtration. The purpose of the experiments was to determine if the cooling and depressurization of coal-leachant slurry after hydrothermal leaching treatment results in precipitation, on product coal, of species containing sulfur, sodium, and ash that were soluble at the conditions of the hydrothermal leaching treatment. In the experiments, the coal-leachant slurry was filtered at 250° C and 600 psi. The resulting coal was washed three times at 250° C, carrying out pressure filtration between washes.

As shown by data presented hereinafter, the sulfur, ash, and the sodium contents were significantly lower, when pressure filtration was used, by comparison with the results of a standard leaching experiment.

The above results explain why the ash, the sodium, and, quite often, the sulfur contents of the product coal have been observed to increase during slow cooling of the product slurry.

SUMMARY

In accordance with this invention, there is provided a method of treating fine particles of a solid carbonaceous fuel of the coal or coke type to reduce its content of undesired constituents at least including sulfur or ash or both, comprising, forming a mixture of the fuel particles with a liquid aqueous leaching solution, containing one or more cations selected from Groups IA and IIA, which is effective to dissolve the undesired constituents, exposing the mixture to temperatures in the range of about 150° to 375° C under a pressure of at least the autogenous steam pressure until the solution has dissolved the undesirable constituents of the fuel to such an extent that the undesired constituent content of the fuel particles has been reduced to less than a desired limiting value, and separating the major portion of the solution from the fuel particles under temperature and pressure conditions and within a time period such that the amount of the undesired constituents dissolved in the solution is not substantially reduced by precipitation, adsorption on the fuel particles, or chemical recombination therewith.

Typically, the separation step comprises filtering the solution to remove the solid fuel particles.

The temperature of the mixture is typically maintained in the range of about 100° to 375° C during the separation step. Desirably, the temperature and pressure of the mixture during the separation step are maintained at about the same values as those used during the dissolving step.

Subsequently the separated solution may be heated to a higher temperature to selectively precipitate inorganic oxides from the solution.

The separated solution may be subsequently cooled to selectively precipitate metal values therefrom.

Alternately the method may, after the dissolving step, comprise rapidly cooling the mixture to less than 100° C prior to the separating step, and performing the separating step before a substantial portion of the undesired constituents has precipitated from the cooled solution.

DRAWINGS

DETAILED DESCRIPTION

Figure 1:
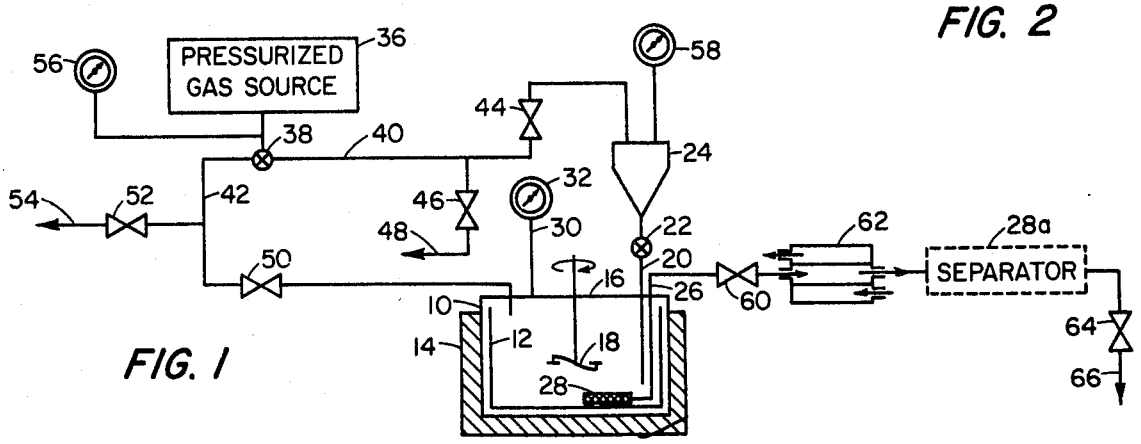
FIG. 1 is a schematic drawing of one form of apparatus for performing the method of the invention, either as a laboratory procedure or as an industrial batch process.

Referring to FIG. 1, the numeral 10 indicates a pressure vessel which may be an industrial vessel, a laboratory autoclave or the like. The vessel 10 has a liner 12, as of stainless steel, capable of withstanding the caustic leaching solutions commonly used. The vessel 10 is heated by suitable means, here shown as a furnace 14. The vessel is also equipped with a cover 16 which supports a suitable stirring mechanism 18 such as an electromagnetic stirring mechanism.

A feed pipe 20 extends through the cover 16, and is connected by a ball valve 22 to a charging bomb 24. An outlet pipe 26 also extends through the cover 16, and the lower end of the pipe is connected to a filter 28, which may comprise a stainless steel frit, located in the bottom of the vessel 10. Also penetrating the cover 16 are connections 30 for a pressure gauge 32 and a purging line 34.

A pressurized gas source 36 is connected to the system through a three-way valve 38. Three-way valve 38 allows the pressurized gas supply to be shut off or to be connected to either of the two lines 40 or 42. Line 40 is connected through a valve 44 to the charging bomb 24, and also via a valve 46 to a purge line 48. Line 42 is connected via valve 50 and line 34 directly into the top of the pressure vessel 10, and is also connected via valve 52 to a purge line 54.

The gas pressure provided by the source 36, which may be a nitrogen tank, is indicated by a pressure gauge 56, and the pressure in the charging bomb 24 is indicated by a pressure gauge 58. The outlet pipe 26 for the pressure vessel 10 is connected through a valve 60 to a heat exchanger 62. The outlet of the heat exchanger 62 is connected through an optional separator **28*a* and a valve 64 to a discharge line 66**.

The apparatus of FIG. 1 may be used according to the invention for treating fine particles of a solid carbonaceous fuel of the coal or coke type to reduce its content of undesired constituents, at least including sulfur or ash or both. The fuel particles may comprise ground coal, and are mixed with a liquid aqueous leaching solution, containing one or more cations selected from Groups IA and IIA of the periodic table, which is effective to dissolve the undesired constituents. The coal preparation method and the nature of the leaching solution are fully described in the above-referenced copending applications, and accordingly no detailed description is necessary herein.

Typically, the fuel particles are mixed with the leaching solution to form a slurry, which may be loaded into pressure vessel 10 either by removing the cover thereof or by charging the vessel by the use of the charging bomb 24. As shown, the charging bomb 24 is preferably hopper shaped in order to channel the slurry into the pipe 20 containing the ball valve 22. The ball valve is used to provide an unrestricted conduit for the slurry through the pipe 20 into the vessel 10 when the valve is open. The flow of the slurry is assisted by pressurizing the charging bomb using the pressure source 36 to apply gas pressure through the valves 38 and 44 until an appropriate charging pressure reading is obtained on the gauge 58, at which time valve 44 may be closed.

While charging the vessel 10, the pressure therein can be relieved by opening the valves 50 and 52 to the purge line 54. An indication that the fluidous contents of charging bomb 24 have been transferred to pressure vessel 10 is provided when equal pressures are registered on gauges 32 and 58. if desired, any remaining fuel particles in the charging bomb 24 can be flushed into the pipe 20 by passing a small quantity of clear leaching solution through the bomb as a rinse. The pressure vessel is sealed by closing the valves 22 and 50.

The slurried mixture of fuel particles and leaching solution in vessel 10 is now exposed to temperatures in the range of about 150° to 375° C. Ordinarily, the fuel particles and the solution are first mixed together and then heated, but it is possible to first heat the fuel particles and the solution separately, if desired.

The mixture is exposed to the high temperatures under a pressure of at least the autogenous steam pressure obtained in the vessel 10 due to the fact that the vessel is sealed and that high pressure steam is generated therein. The mixture is exposed to the high temperature and pressure until the solution has dissolved the undesired constituents of the fuel to such an extent that the undesired constituent content of the fuel particles has been reduced to less than a desired limiting value. The kinds of leaching solutions, their concentrations and the exposure times to be used are described at length in the above-referenced copending applications, and accordingly no detailed description is necessary herein.

The major portion of the solution is now separated from the fuel particles under temperature and pressure conditions and within a time period such that the amount of the undesired constituents dissolved in the solution is not substantially reduced by precipitation, adsorption on the fuel particles or chemical recombination with the fuel particles.

It was noted by Reggel, L., Raymond, R., Wender, I., and Blaustein, B.D., in their article "Preparation of Ash-Free, Pyrite-Free Coal by Mild Chemical Treatment", Preprints, Division of Fuel Chemistry, ACS, V. 17, No. 1, August 1972, pp. 44–48 that a puzzling increase in organic sulfur occurred erratically when coal was treated with a sodium hydroxide solution followed by acidification. They suggested that it was possible that elemental sulfur was precipitated either at some stage of the reaction, or during the acid "workup" of the product, and that one possible method of preventing an increase in organic sulfur would be to remove the sulfide-containing alkali solution from contact with the coal before any workup was done. However, Reggel et al did not specifically identify the cause of the problem solved by the present invention, nor did they discover the conditions under which the alkali solution must be removed from contact with the coal.

Referring again to FIG. 1, in a typical procedure for implementing the method of the present invention, the separation step comprises filtering the solution to remove the solid fuel particles. The temperature of the mixture is typically maintained in the range of about 100° to 375° C during the separation step. Desirably, the temperature and pressure of the mixture during the separation step are maintained at about the same values as those used during the dissolving step.

As illustrated in FIG. 1, the filtering element 28 comprises a stainless steel frit located in the bottom of the pressure vessel 10. When the valve 60 is open, the autogeneous steam pressure, together with any partial pressure of gas which may be applied from the source 36 can force the solution through the filter 28, the pipe 26 and the valve 60 into the heat exchanger 62. In the heat exchanger 62, the heat contained in the hot solution is eventually absorbed by a cooling solution. The cooling solution may be simply water or it may be a quantity of leaching solution being heated up prior to mixing a batch of slurry to be transferred to a pressure vessel, similar to the pressure vessel 10, or even to the pressure vessel 10 per se, as a conventional heat-saving expedient. After passing through the heat exchanger 62, the spent leaching solution has cooled sufficiently to enable it to be transferred through the valve 64 and the delivery pipe 66 to a receiving vessel at atmospheric pressure.

It can be noted incidentally that the combination of the filter 28, the valve 60, the heat exchanger 62 and the valve 64 provides a convenient arrangement for sampling the solution in pressure vessel 10 at any stage of the procedure. For example, assuming that the vessel 10 is pressurized by the autogenous steam pressure, valve 60 can be opened while the valve 64 remains closed, allowing a quantity of the superheated solution to enter and fill the heat exchanger 62 under proper cooling conditions. The valve 60 can then be closed and the valve 64 opened to drain off a sample of the solution for analysis or the like. During all this time, the contents of the vessel 10 can be maintained at substantially the same temperature and pressure, or the temperature and pressure can be varied between samples.

When as much of the solution as possible has been forced out of the vessel 10, the remaining "cake" of fuel particles can be removed from the vessel. This can be done by allowing the vessel to cool and removing the fuel particles manually from the uncovered vessel, or suitable manual or automatic arrangements can be made for back-flushing the filter 28 and automatically draining the resulting slurry of cleaned fuel particles from the bottom of the vessel. In experiments to be described further hereinafter, the vessel 10 was a laboratory autoclave with a removable cover 16 through which the cleaned fuel particles were retrieved after cooling the vessel. The particles may then be washed with water and dried, or subjected to further process steps as described in the above-mentioned copending applications.

The separated solution recovered from discharge pipe 66 may be subsequently heated to higher temperatures, perhaps temperatures even higher than those used during the dissolving and filtering steps, to selectively precipitate certain inorganic oxides from the solution. It has been found also that the separated solution can be subsequently cooled in order to selectively precipitate metal values from the solution.

The solid-lined portion of FIG. 1 has illustrated a process specifically using a filter to separate the spent leaching solution from the fuel particles at or near the temperatures and pressures used during the step of dissolving the undesired constituents in the coal. However, we have also discovered an alternate procedure which can be used in many cases to achieve sastisfactory results. According to this alternate procedure, after the undesired constituents have been dissolved to the extent required at the elevated temperature and pressure, the mixture of leaching solution and fuel particles is rapidly cooled to a temperature less than 100° C prior to the separating step, and the separating step is performed before a substantial portion of the undesired constituents has precipitated from the cooled solution.

The alternate procedure can be implemented by an apparatus similar to that previously described with reference to FIG. 1, but with the filter 28 moved from the inside of pressure vessel 10 to the outlet of heat exchanger 62, as shown by the dashed-line box identified as separator **28*a***. Particularly in this alternate location, the separation of the leaching solution from the fuel particles can be carried out by other forms of separators such as centrifuges or hydroclone separators as well as by filters. Suitable modification of the outlet piping arrangement as well as the heat exchanger may be necessary in order to obtain the best results from the alternate separation procedures. For example, the heat exchanger requirements may include a higher flow capacity and a greater cooling capacity. With a suitably designed system, the quick cooling and separation of the mixture can be effected before substantial nucleation and agglomeration processes have proceeded far enough to produce significant precipitation, before substantial adsorption of the dissolved constituents can occur, and before any chemical recombination processes have had time to proceed to a significant extent.

As is now well known, coal is subject to wide variability as to hardness, organic composition and mineral content. This is true even for coal samples taken at different times from the same mine on a run-of-the-mine basis. Optimum values for concentrations, time and temperatures can be expected to vary accordingly, and these parameters should be adjusted as necessary to suit specific operating conditions.

Figure 2:
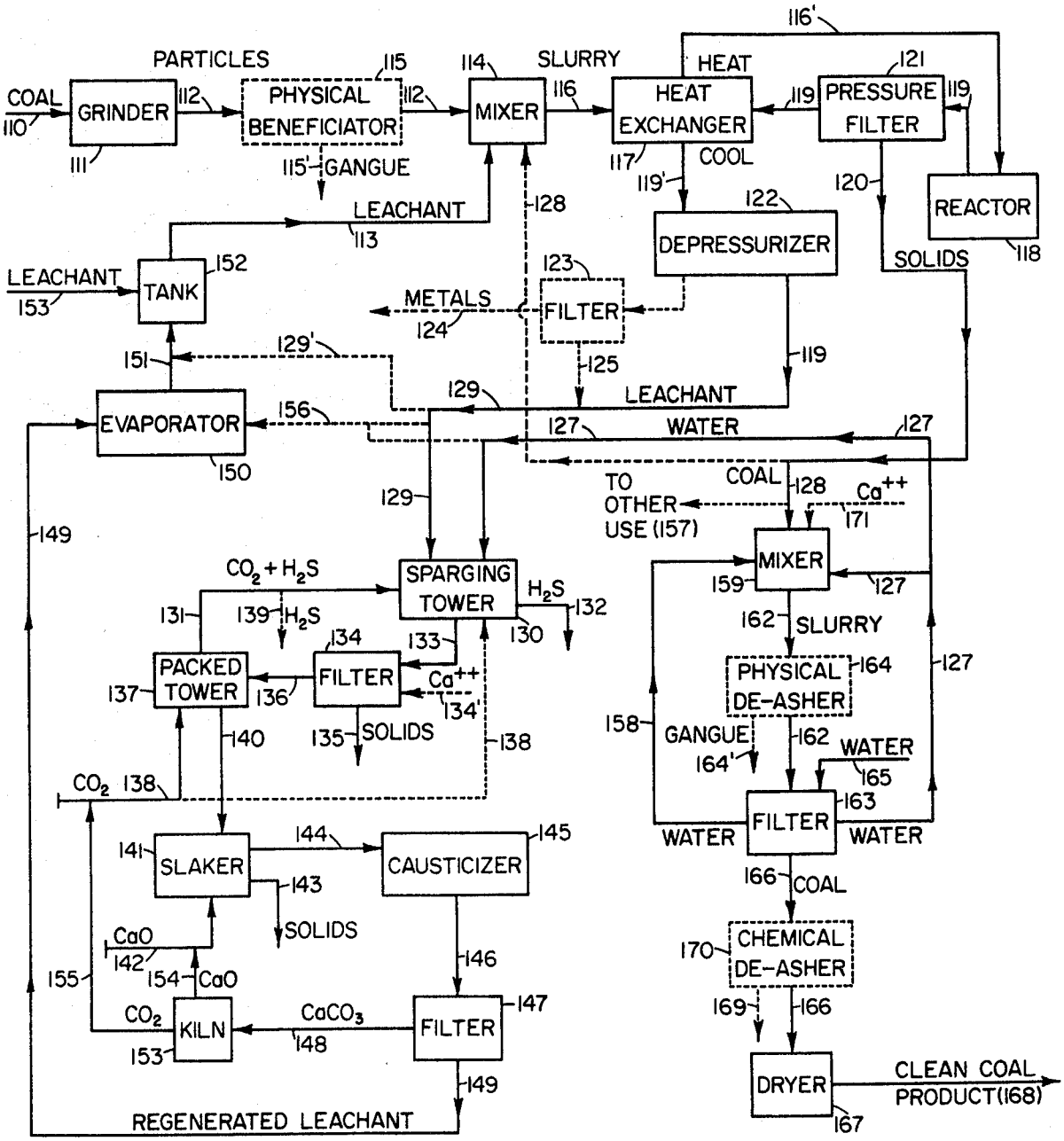
FIG. 2 is a flow diagram illustrating typical apparatus and steps to produce, on a continuous basis, low-sulfur and low-ash coal having increased reactivity, while simultaneously regenerating the spent leachant.

Referring now to FIG. 2, raw coal 110, either washed or untreated, is passed into a grinder 111 which may be any suitable known device for reducing solid matter to a finely divided state. The finely divided coal particles 112 and a leachant solution 113, typically comprising an aqueous alkaline solution of a sodium compound, are passed into a mixer 114 where they are mixed. (If low-ash, as well as low-sulfur product coal is desired, before passing into the mixer 114 the finely divided coal particles 112 may optionally be passed through a physical beneficiator 115 where their ash and pyritic sulfur contents are reduced, with the resulting gangue being removed via a stream 115'.)

From the mixer 114 the coal-leachant slurry 116 is passed through the heating zone of a heat exchanger 117 to increase its temperature. The heated slurry 116' is then passed into a high-pressure, high-temperature reactor 118 where the leaching reaction takes place. A stream 119 containing a solid phase consisting essentially of low-sulfur fuel particles, and a liquid phase consisting essentially of an aqueous solution of dissolved organic matter, sodium-sulfur species, and unused leachant is passed through the cooling zone of the heat exchanger 117 to lower its temperature. Before passing into the heat exchanger 117 the stream 119 is passed through a pressure filter 121, with the remaining liquid phase then passing through the heat exchanger 117 and a depressurizer 122. Optionally the stream 119 is then passed into a filter 123 where the precipitated metal values 124 are removed and the spent leachant 125 is discharged as a stream 129.

From the heat exchanger 117 the cooled stream 119' passing through the depressurizer 122 may then be discharged directly as a stream 129 comprising mostly spent leachant.

The stream 129 and a process water stream 127' are passed into a sparging tower 130, and a gas stream 131 containing carbon dioxide and hydrogen sulfide, discussed below, is passed counter-currently through the sparging tower 130 so as to partially carbonate the spent leachant therein to form sodium carbonate. Hydrogen sulfide gas is removed via a gas stream 132 and may be converted to experimental sulfur by any of a number of well known conversion processes. The partially carbonated spent leachant solution 133 is then passed through a filter 134, with the solid organic matter 135 being separated out. (As indicated at 134', calcium ions may be added to the filter 134 to increase the rate of filtration.) The spent leachant solution 136 is passed from the filter 134 into a packed tower 137 where a gas stream 138 containing carbon dioxide is passed through counter-currently so that any remaining spent leachant is carbonated. (The gas stream 138 may also be passed to the sparging tower 130 in addition to or instead of the stream 131.) Hydrogen sulfide and carbon dioxide are passed from the packed tower 137 via the gas stream 131, and at least part of the hydrogen sulfide may be removed from the stream 131 via a gas stream 139 and converted to elemental sulfur by any known process.

The carbonated leachant, solution 140, comprising mostly sodium carbonate, is then passed from the packed tower 137 to a slaker unit 141 where calcium oxide 142 is mixed with it. After the large solids have been removed via a stream 143, the carbonated leachant solution 144 is passed into a causticizer 145 where leachant regeneration, i.e., conversion of sodium carbonate to sodium hydroxide, takes place. The slurry 146 of sodium hydroxide solution and calcium carbonate is passed to a filter 147 where the solid calcium carbonate 148 is separated from the regenerated sodium hydroxide (leachant) solution 149. The leachant 149 is passed from the filter 147 to an evaporator 150 where it is concentrated, and the concentrated regenerated leachant stream 151 is passed from the evaporator 150 to a storage tank 152. New leachant is also added to the storage tank 152 via a stream 153 and the combined new and regenerated leachant is conveyed as the stream 113 to the mixer 114.

The calcium carbonate 148 from the filter 147 is passed to a kiln 153 where, as a result of heating, it is converted to calcium oxide 154 and carbon dioxide 155, with the former being mixed with the calcium oxide stream 142 and the latter being mixed with the carbon dioxide stream 138. (Some of the spent leachant stream 129 and the water stream 127' may be taken directly via a stream 156 to the evaporator 150, and some of the leachant stream 129 by itself may be taken directly via a stream 129' to the tank 152 without the need for regeneration.)

Coal particles 120 taken directly from the pressure filter 121 form a stream 128 which may be fed to a utilization point 157 or may be reslurried with process water streams 127 and 158 in a mixer 159. (Where so desired, the coal stream 128 may optionally be passed back into the mixer 114 where a different leachant solution 113 may be added, and subsequent steps repeated.) The coal-water slurry is then passed, as indicated at 162, into a filter 163. (If a low-ash, as well as a low-sulfur, product coal is desired, then before passing into the filter 163 the slurry 162 may optionally be passed through a physical de-asher 164, the resulting gangue being removed via a stream 164'.) The liquid phase of the slurry (i.e., the water) is discharged from the filter via the stream 127 which is supplied to the sparging tower 130 and the mixer 159 as described above. The solid phase of the slurry (i.e., the coal) retained in the filter 163 is washed with a water stream 165 and the wash water is discharged as the stream 158. The separated coal particles 166 may then be passed to a dryer 167 if a low moisture product coal 168 is desired. (If a low-ash and low-sodium, as well as low-sulfur, product coal is desired, then before or as an alternative (169) to passing into the dryer 167, the coal particles 166 may optionally be passed through a chemical de-asher 170.)

Several experiments were carried out on high-temperature, high-pressure filtration. The data for the experiments are shown in Table 1. The purpose of the experiments was to determine if the cooling and depressurization of coal-leachant slurry after hydrothermal leaching treatment results in precipitation, on product coal, of species containing sulfur and ash (including sodium) that were soluble at the conditions of hydrothermal treatment. In the experiments, the coal-leachant slurry was filtered at 250° C and 600 psi. The resulting coal was filtered and washed three times at 250° C, applying pressure filtration between washes. The preliminary results indicate that the sulfur and the ash content of the product coal are significantly lower than reported above in standard leaching without pressure filtration.

TABLE 1.

EFFECT OF PRESSURE FILTRATION ON PRODUCT ANALYSIS

| Product Analysis (MAF)* | Sample No. [a] Raw Coal | 31310-64C | 31529-17$C_2$ |
|---|---|---|---|
| Moisture | 0.40 | 1.32 | 0 |
| Ash (as reported) | 10.3 | 15.8 | 12.6 |
| Sodium-and $SO_4$-free ash | 10.2 | 9.6 | 7.6 |
| Sodium | 0.03 | 2.47 | 1.83 |
| Total Sulfur | 2.65 | 1.23 | 1.07 |
| Pyritic Sulfur | 1.68 | 0.26 | 0.33 |
| Organic Sulfur | 0.92 | 0.87 | 0.70 |
| Sulfate Sulfur | 0.04 | 0.11 | 0.04 |

[a]Both the leaching experiments were carried out at 250 C on Montour mine coal using an NaOH concentration of 4 percent, an NaOH to sulfur ratio of 7, and a leaching time of 60 minutes.
*Moisture and ash-free.

Another example of the advantages of pressure filtration is shown in Table 2. In Sample 31689-7 in which the pressure filtration was not applied the product was observed to contain 29.2% ash, 0.85% sodium and 1.40% total sulfur. On the other hand, the product from the pressure filtration experiment (Sample No. 31310-97$C_2$) contained much reduced concentrations of ash (18.6%), sodium (0.13%) and total sulfur (0.95%).

TABLE 2.

PRODUCT ANALYSIS WITH AND WITHOUT PRESSURE FILTRATION

| Product Analysis (MAF) | Sample No. 31689-7[a] | 31310-97$C_2$[b] |
|---|---|---|
| Ash, % | 29.2 | 18.6 |
| Sodium, % | 0.85 | 0.13 |
| Total Sulfur, % | 1.40 | 0.95 |

[a]NaOH/coal, water/coal, CaO/coal ratios were 0.16, 2.5 and 0.13 respectively.
[b]NaOH/coal, water/coal and CaO/coal ratios were 0.18, 2.83 and 0.13 respectively.

Reactions were conducted at 250° C and with 60 and 90 minutes leaching time respectively. The 90 minute leaching time, in fact, has been found to be less favorable to sulfur and ash reduction than the 60 minute leaching time.

While the invention has been illustrated and described in terms of specific procedures and specific apparatus, such description is meant to be illustrative only and not restrictive, since many changes and modifications can obviously be made without departing from the spirit and scope of the invention.

We claim:

1. A method of treating fine particles of a solid carbonaceous fuel of the coal or coke type to reduce its content of undesired constituents at least including sulfur or ash or both, comprising, forming a mixture of the fuel particles with a liquid aqueous leaching solution, containing one or more cations selected from Groups IA and IIA, which is effective to dissolve the undesired constitutents, exposing the mixture to temperatures in the range of about 150° to 375° C under a pressure of at least the autogenous steam pressure until the solution has dissolved the undesired constituents of the fuel to such an extent that the undesired constituent content of the fuel particles has been reduced to less than a desired limiting value, separating the major portion of the solution from the fuel particles under temperature and pressure conditions and within a time period such that the amount of the undesired constituents dissolved in the solution is not substantially reduced by precipitation, adsorption on the fuel particles, or chemical recombination therewith.

2. A method as in claim 1 wherein the separation step comprises filtering the solution to remove the solid fuel particles.

3. A method as in claim 1 comprising maintaining the temperature of the mixture in the range of about 100° to 375° C during the separation step.

4. A method as in claim 3 comprising maintaining the temperature and pressure of the mixture during the separation step at about the same values as those used during the dissolving step.

5. A method as in claim 1 comprising subsequently heating the separated solution to a higher temperature to selectively precipitate inorganic oxides therefrom.

6. A method as in claim 1 comprising subsequently cooling the separated solution to selectively precipitate metal values therefrom.

7. A method as in claim 1 which comprises rapidly cooling the mixture to less than 100° prior to the separating step, and performing the separating step before a substantial portion of the undesired constituents has precipitated from the cooled solution.

* * * * *